United States Patent [19]

Moule

[11] 3,938,638

[45] Feb. 17, 1976

[54] APPARATUS FOR RECEIVING AND ACKNOWLEDGING THE RETURN OF A VEHICLE AT A CHECK-IN STATION

[75] Inventor: Richard D. Moule, South Pasadena, Calif.

[73] Assignee: Franklin Electric Subsidiaries, Inc., Bluffton, Ind.

[22] Filed: Dec. 17, 1973

[21] Appl. No.: 425,107

[52] U.S. Cl. ..... 194/4 C; 49/49

[51] Int. Cl.[2] ..... G07F 7/06

[58] Field of Search ..... 194/4, DIG. 23, DIG. 1; 49/35, 49

[56] References Cited

UNITED STATES PATENTS

| | | | |
|---|---|---|---|
| 2,347,194 | 4/1944 | Holliday | 194/DIG. 23 |
| 2,528,790 | 11/1950 | Scherer | 194/DIG. 23 |
| 2,818,955 | 1/1958 | Stackhouse | 194/4 F |
| 2,842,876 | 7/1958 | Chicoine | 49/35 |
| 3,165,189 | 1/1965 | Easterday | 194/4 F |
| 3,194,377 | 7/1965 | Fischbach | 194/4 R |
| 3,606,698 | 9/1971 | Tanaka | 49/35 |
| 3,685,626 | 8/1972 | Cotton | 194/4 C |
| 3,754,630 | 8/1973 | Gilrer | 194/4 C |

*Primary Examiner*—Robert B. Reeves
*Assistant Examiner*—Francis J. Bartuska
*Attorney, Agent, or Firm*—Paul & Paul

[57] ABSTRACT

Apparatus for receiving and acknowledging the return of a wheeled vehicle to a check-in station, as for example, a grocery service cart. The apparatus includes a rugged, foolproof sensor required to operate in predetermined sequence thereby to thwart efforts to decipher the mode of operation needed to give a false acknowledgment of a returned vehicle or permitting reception of the same vehicle more than once from the same person. All sensor components are adapted to be mounted on a base plate supporting a return entry port and passageway. The apparatus is readily adjustable to accommodate vehicles of different size. Access to control components is safeguarded by a locked cover equipped with tamperproof retainers and means for preventing reassembly of the sensor cover by persons who have gained access without authorization.

40 Claims, 11 Drawing Figures

APPARATUS FOR RECEIVING AND ACKNOWLEDGING THE RETURN OF A VEHICLE AT A CHECK-IN STATION

This invention relates to an apparatus for receiving and acknowledging the return of a vehicle at a check-in station, and more particularly to an improved and unique device of this type having failsafe, foolproof means thwarting attempts by unauthorized persons to gain access to the mechanism or to manipulate the mechanism and provide spurious results.

Various proposals have been made heretofore for automatic equipment operable to detect and acknowledge the return of a wheeled vehicle to a check-in station. Carts and vehicles of various types are currently utilized and available to the public for various uses following which it is important that the vehicle be returned to a check-in point or station. Such vehicles are in common use in travel stations and depots for use in handling luggage, parcels and the like as well as by shoppers while selecting articles of merchandise and transferring these to a passenger vehicle. In conducting these operations, it is desirable but appropriate provision be made for encouraging users to return the vehicle to an appropriate storage area and in return, to receive a suitable receipt or in many cases, some form of reward for their cooperation.

Efforts heretofore made to satisfy these objectives are subject to various shortcomings and disadvantages sought to be avoided by the present invention. For example, if a suitable reward is issued it has been found that certain persons tend to abuse the procedure and resort to various expedients to obtain unearned and multiple increments of the reward. Proposals have been made to defeat these attempts by providing one or more sensors required to operate or to be manipulated in a particular manner in order to release the reward. One of these proposals utilizes means to prevent retrograde movement of the cart through the check-in station to permit repeated cycling of the check-in operation. Other proposals include sensor means responsive to the weight of a vehicle wheel as it enters the check-in station functioning in cooperation with a mechanical interlock to control dispensing of a token. However, little ingenuity is involved to manipulate each of these control devices manually and without regard to a programmed sequence. Furthermore, one of the controls can be accidentally or deliberately manipulated at any time to dispense a single token.

In view of the foregoing and the demonstrated cleverness of certain persons and the challenge to the ingenuity of others to defeat tamper-proof devices, there is provided by this invention a vehicle check-in apparatus so designed and constructed as to defy the efforts of the most ingenious and painstaking persons to detect the order and means for operating a programmed series of steps required to be performed as a vehicle enters the station in a prescribed direction in order to acknowledge its return and thereupon automatically restoring the operating cycle to its initial starting condition with certainty and without need for supervision or an attendant.

As herein shown, the invention apparatus is arranged to receive a typical vehicle, such as a shopping cart of the type widely used having relatively closely spaced front wheels and more widely spaced rear wheels. No attachment or change of any kind is required in the cart itself. Typically, the check-in station comprises a floor-supported plate and an upright rigid main frame defining an entry port. Adjustable barriers secured to the floor plate define guide channels for the wheels and assure that the cart passes through the station properly centered and oriented. Secured to the base plate is a sensor mechanism having a plurality of freely swinging sensor arms normally maintained in a neutral extended position in the path of the wheels and each controlling the operation of one or more electrical switches each operatively associated with an independent control circuit with the sum total of the control circuits required to be activated in a particular sequence to provide an output signal. IF and when this output signal is generated it is If to control an acknowledgment device and to restore the sensor mechanisms to their respective original starting conditions. Reverse movement barrier means are provided safeguarding against any possibility of a vehicle being passed through the station in reverse direction for repeated cycling of the check-in operation. Additionally, all parts of the equipment are readily adjustable to accommodate vehicles of different sizes and designs.

Accordingly, it is a primary object of the present invention to provide improved and unique vehicle check-in and acknowledgment apparatus which functions in a reliable and foolproof manner without need for supervision or an attendant.

Another object of the invention is the provision of a vehicle check-in station having sensor means responsive to the passage of the vehicle to operate and acknowledge the return of a vehicle and to restore the equipment to its initial condition.

Another object of the invention is the provision of a vehicle check-in station having foolproof, tamper-proof sensor means operable to acknowledge the return of the vehicle with positive means for safeguarding against manipulation to provide false or spurious acknowledgments.

Another object of the invention is the provision of a vehicle check-in station having foolproof means preventing retrograde movement of a vehicle backwardly through the station entrance.

Another object of the invention is the provision of a vehicle check-in station which is completely self-contained and installable directly on the ground or floor and including means preventing retrograde movement of a vehicle therethrough.

Another object of the invention is the provision of improved and unique sensor means for detecting the passage of a vehicle therepast and constructed and arranged to thwart manual manipulation falsely simulating the passage of a vehicle.

These and other more specific objects will appear upon reading the following specification and claims and upon considering in connection therewith the attached drawing to which they relate.

Referring now to the drawing in which a preferred embodiment of the invention is illustrated:

THE CHECK-IN STATION GENERALLY

Figure 1:
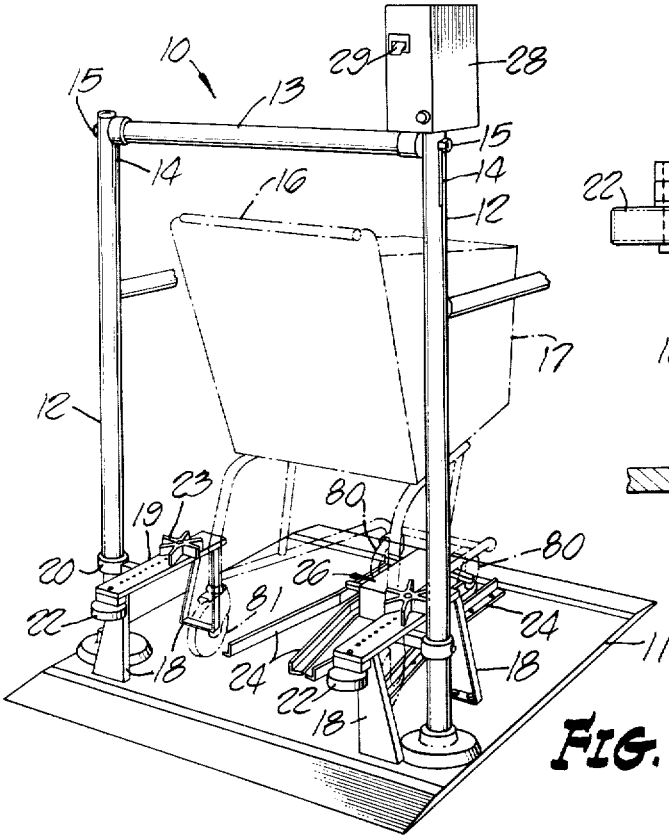
FIG. 1 is a perspective view of an illustrative embodiment of the invention as viewed from the entrance end of the vehicle passageway and indicating by dot and dash line a typical shopping cart in the process of passing therealong.

Referring initially more particularly to FIGS. 1–4, there is shown an illustrative embodiment of the invention check-in station, designated generally 10, having a main frame comprising a rigid base plate 11 supporting an inverted U-shaped frame 12 having a vertically adjustable cross bar 13 clampable in different vertical positions along slots 14, 14 by means of clamping nuts 15. It will be understood that the cross bar 13 is preferably sc adjusted as to clear the handle 16 of a particular size cart 17 without risk of injury to the customer's fingers if present on handle 16 but also low enough to prevent lifting the vehicle up and back out of the frame.

Figure 3:
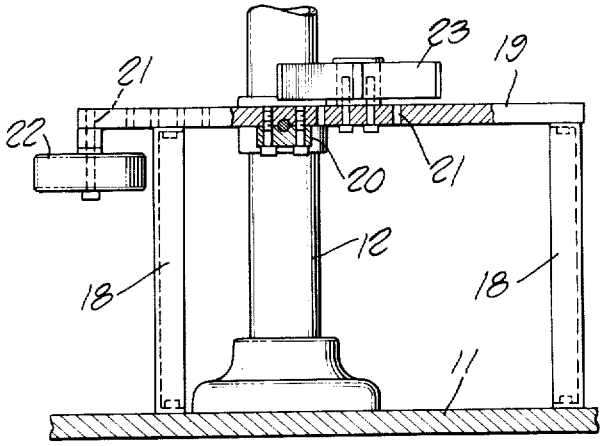
FIG. 3 is a fragmentary cross-sectional view on an enlarged scale taken along line 3—3 on FIG. 2.
Figure 4:
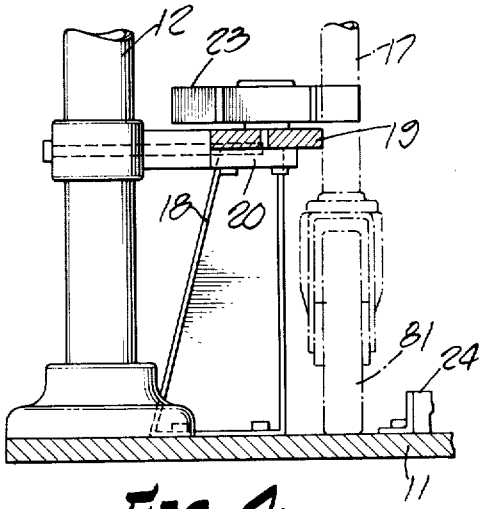
FIG. 4 is a fragmentary cross-sectional view on an enlarged scale taken along line 4—4 on FIG. 2.

The rigidity of frame 12 relative to base plate 11 is augmented by the adjustable brackets best shown in FIGS. 3 and 4. These brackets include a pair of upright brackets 18, 18 interconnected at their upper ends by a plate 19. The midportion of plate 19 is rigidly secured to frame 12 intermediate the ends of this plate by bracket 20. It will be understood that brackets 18, 18 are shiftable to various positions relative to base plate 11, to accommodate vehicles or carts of different widths. Desirably, the adjacent longer edges of plate 19 are so positioned as to have fairly close clearance with the exterior sides of the rear legs of the cart carriage. This assures that the cart will be properly and accurately aligned centrally of the check-in station passageway and that one rear leg will make good electrical contact with one of the plates 19 and/or star wheels 23 for a purpose to be explained presently.

Each of the plates 19 includes a series of closely spaced holes 21 in some of which a guide roller 22 is adjustably supported and in others of which at least one one-way rotary star wheel 23 is supported. Star wheel 23 is of any well known construction having an internal ratchet mechanism of well known construction permitting free rotation of the wheel in a direction permitting forward passage of the rear legs of cart 17 but positively preventing retrograde rotation in a direction permitting backward movement of the cart through the entrance end of the check-in station 10.

Figure 2:
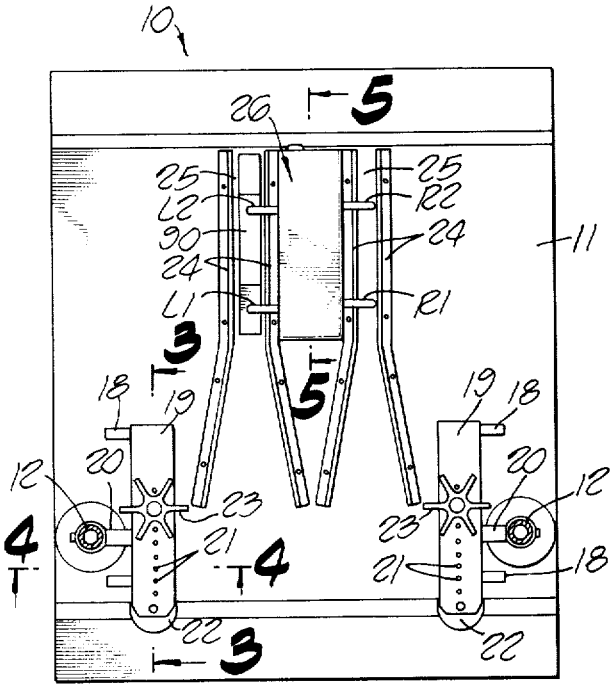
FIG. 2 is a horizontal cross-sectional view showing the passageway per se and the supporting base therefor.

As is best shown in FIG. 2, base plate 11 is provided with a plurality of guide rails provided by angle irons 24, 24 having parallel forward ends and rearwardly flaring rear ends to form passageways 25, 25 along which the front wheels of the cart pass. Angle irons 24 are laterally adjustale to different positions on base plate 11 as necessary to accommodate the spacing of the front wheels of a particular cart or vehicle. It will be understood that, when using a vehicle of the type here illustrated, the more widely spaced rear wheels travel along paths outwardly of the two outermost angle irons 24.

The vehicle sensor device 26 is suitably secured to base plate 11 between the front wheel passageways 25, 25 and includes a pair of arms R1, R2 projecting laterally from its right hand side and a second pair of arms L1, L2 projecting laterally from its left side and movable forwardly and rearwardly of the normal or neutral outstretched positions thereof shown in FIG. 2. These arms and the control devices controlled thereby will be described in detail presently.

Referring now to FIG. 1 it will be understood that main frame 12 includes a vehicle return acknowledgment device of any suitable character. As herein shown, the acknowledgment device comprises a stamp dispenser 28 of any well known electrically driven type for dispensing one or more stamps or the like increments 29 of a continuous strip of material housed within the dispenser. For example, the increment 29 so dispensed may comprise a receipt for the return of a single vehicle or it may comprise a trading stamp or the like of suitable value issued each time a cart passes through the check-in station 10 and redeemable for a stated amount of merchandise in payment to the customer for returning the cart to the check-in station.

SENSOR DEVICE

Constructional details of sensor device 26 are best shown in FIGS. 5–8. This device has a channel shaped main frame comprising a base plate 30 (FIGS. 5 and 6) and upright sidewalls 31 secured to the opposite edges thereof by bolts 32. This rigid main body is preferably enclosed by a pair of internesting covers includig an inner cover 33 and an outer cover 34 each of inverted U-shape. The left hand end of inner cover 33 has an inwardly projecting lip 35 insertable horizontally beneath a cross bar 36 fixed to the left hand end of base 30. Secured, as by welding, to the interior of the right hand end wall of cover 33 is a locking clip 37 likewise engageable beneath a cross piece 38 fixed to base 30 by bolts 32. Cover 33 is shown in its assembled position in FIG. 5 with lip 35 and the corresponding portion of clip 37 engaged beneath the respective cross-pieces 36 and 38 and locked in this position by a key operated lock 39 mounted against the interior of the right hand end wall of the cover. When locked, the key operated lug 40 will be understood as projecting horizontally into a position to engage the fixed abutment 41, provided by the adjacent end of casting 50, if one endeavors to shift cover 33 to the left to disengage lip 35 and clip 37 from cross-pieces 36, 38. However, if locking lug 40 is rotated 90° to its unlocked vertical position, then the cover can be shifted to the left and lifted vertically from the sensor device provided of course that outer cover 34 is detached.

The second and outer cover 34 includes similar tamper-proof locking expedients. Thus, the left hand end wall of this cover has an inturned lip 43 engageable beneath a locking tang 44 fixed to base 11. Likewise, the forward end wall of the cover has a locking clip 45 secured to its interior side, as by spot welding, and is engageable beneath a locking tang 46 fixed to base 11. A key operated lock 47 has its locking lug 48 projecting downwardly in position to engage a fixed abutment 49 likewise suitably fixed to the base 11. However, when locking lug 48 is rotated 90° by the key, now shown, so as to project horizontally, it is clear of abutment 49 and cover 34 may be shifted bodily to the left sufficiently for lip 43 and clip 45 to disengage tangs 44 and 46, whereupon the outer cover can be lifted away from the main frame.

It will be understood that each of these covers must be manipulated and shifted through a particular precise path in order to assemble or disassemble them with respect to the main frame. This path is not easily ascertained because the tangs with which the locking lips and clips engage are concealed from veiw by the covers when the latter are near to or in the vicinity of their assembled positions. Possibly an unauthorized person gaining possession of the two different keys might succeed in detaching and gaining access to the interior of the sensor device but it is quite unlikely that he could discover how to restore the covers to their assembled positions thereby affording proof that someone had tampered with the device.

The right hand sensor arms R1, R2 and the left hand sensor arms L1, L2 will now be described with particular reference to FIGS. 5–7. Each of these arms is pivotally supported in a respective casting 50 adjustably secured by bolts 51 to the interior sidewalls 31 of the sensor main body. The operating components associated with each arm are generally similar and a description of one will suffice for all.

Figure 7:
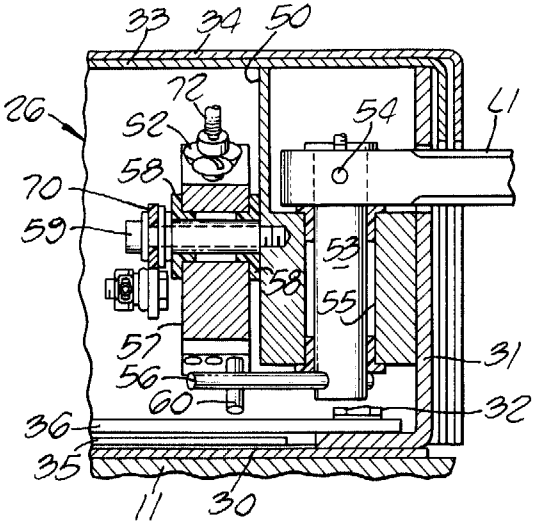
FIG. 7 is a fragmentary cross-sectional view taken along the broken line 7 _ 7 on FIG. 5.

Referring to FIG. 7, it will be noted that arm L1 is fixed to shaft 53 by a pin 54 and is journalled for limited pivoting movement in a vertical bore 55 through casting 50. A pin 56 projects radially from its lower end for a purpose which will be described presently. The two metal-clad mercury switches operated by sensor arm L1 are mounted in a generally L-shaped metal member 57 (FIGS. 5, 7) the mid portion of which is loosely journalled in bearings of insulation material 58, 58 (FIG. 7) supported by a cap screw 59 against the sidewall of casting 50. Projecting downwardly from the lower end of member 57 is an insulated pin 60 located in the path of movement of a radially disposed drive pin 56 fixed to the lower end of shaft 53 for sensor arm L1. It will therefore be clear from a consideration of FIGS. 5, 6 and 7 that clockwise movement of arm L1 will pivot shaft 53 and pin 56 to the left as viewed in FIG. 5 to engage pin 60 and thereby rotate the switch supporting member 57 clockwise about its supporting cap screw 59.

Figure 6:
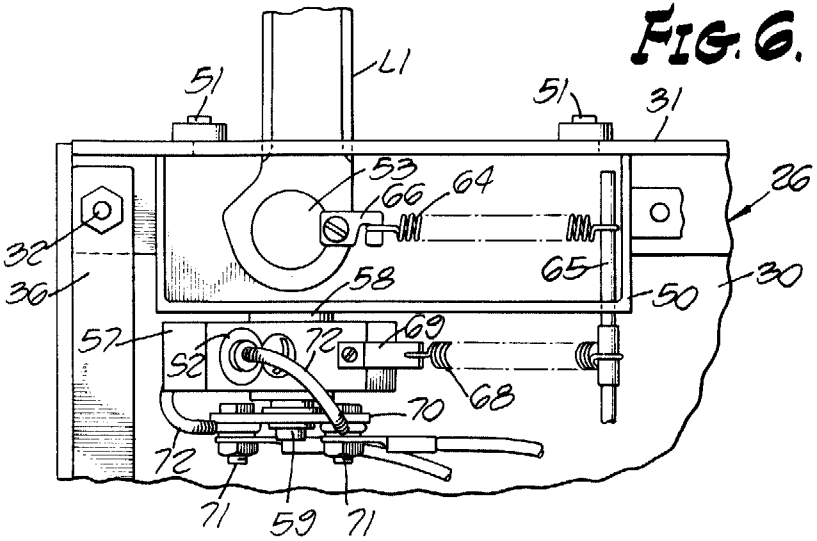
FIG. 6 is a fragmentary plan view of the left hand end of FIG. 5 with the sensor cover detached.
Figure 5:
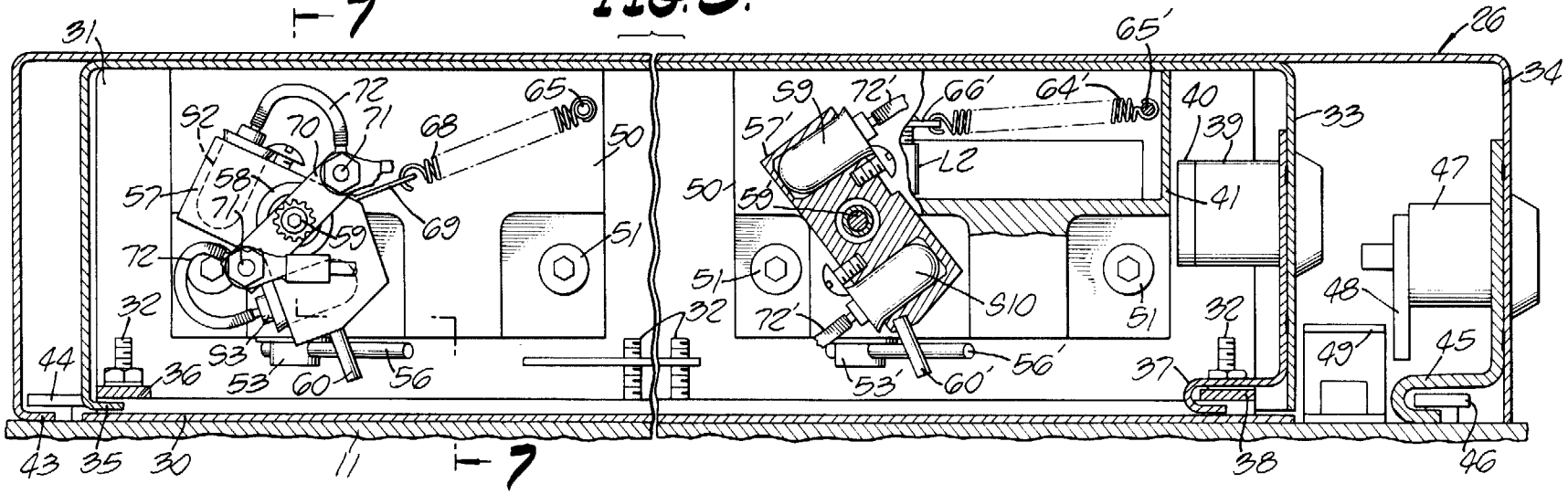
FIG. 5 is a cross-sectional view on an enlarged scale taken along line 5—5 on FIG. 2 and showing certain constructional details of the sensor mechanism.

Referring to FIGS. 5 and 6, it is pointed out that sensor arm L1 is normally biased to a neutral position normal to the sidewall of sensor device 26 by a tension spring 64. This spring has one end fixed to a stationary support 65 and its other end secured to arm L1 by a lug 66 such that the center line of spring 64 is aligned with the axis of the shaft 53 and lying parallel to the side of device 26. Likewise, the switch-supporting member 57 is biased to its normal position of rest shown in FIGS. 5 and 6 by a tension spring 68 having one end supported on fixed support 65 and its other end secured by a lug 69 to member 57, it being noted that, normally, the center line of this spring is aligned with the axis of cap screw 59.

Rigidly fixed to the outer end of cap screw 59 supporting the L-shaped switch carrier member 57 is a strip of insulation 70. A bolt 71 is mounted on either outer end of member 70 and provides an anchorage for separate coil springs 72 forming a flexible lead wire to a respective one of the mercury switches S2, S3. Bolts 71 also provide anchorages for the lead wires connecting each of the switches in circuit with the solid state logic circuitry to be described presently. It will be understood that the coil springs 72 comprise not only the electrical connection to each of the switches but means for adjusting the spring tension tending to hold the switch carrier member 57 in a neutral position as well as means for quickly restoring this member to its neutral position after being deflected from that position during a vehile check-in operating cycle.

It will be understood that sensor arm R1 is equipped with a pair of mercury switches S4, S5 identical with switches S2, S3 and similarly mounted on another one of the L-shaped members 57. The only difference in the two mechanisms is that arm L1 operates in a clockwise direction as it is contacted by the front wheels of the cart, whereas arm R1 operates counterclockwise to move its switch supporting member 57 in a counterclockwise direction but operating the two mercury switches S4, S5 precisely in the same manner as switches S2, S3 are operated by arm L1.

Likewise, it will be understood that the two forward sensor arms L2 and R2 are constructed similarly to the mechanism described in connection with arm L1 except that the mercury switches are mounted at the opposite ends of a straight rather then an L-shaped carrier member. Moreover, it will be understood that the mercury switches S6, S7, controlled by arm R2, lie generally parallel to one another crosswise of the outer ends of the straight carrier members 57′ whereas the similar arm 57′ controlled by arm L2 has a pair of mercury switches S9, S10 mounted thereon similarly to switches S6, S7. Otherwise, the sensor mechanism associated with the front sensor arms L2, R2 are essentially the same as described above in connection with the sensor mechanism operated by arm L1. For this reason, the same or corresponding parts supporting and operating switches S9,S10 need not be described, it being understood that the same or similar parts of the two mehanisms are designated by the same reference characters but distinguished by the addition of a prime.

Figure 8:
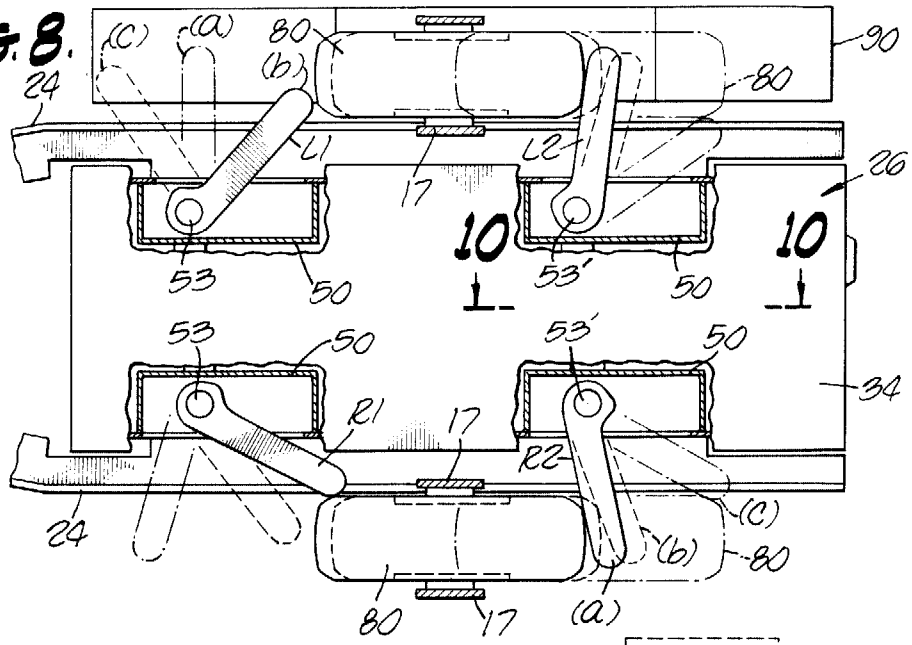
FIG. 8 is a top plan view of the sensor mechanism showing portions of the sensor broken away and indicating three different positions of the front vehicle wheels and the associated three different positions of the sensor arms.
Figure 9:
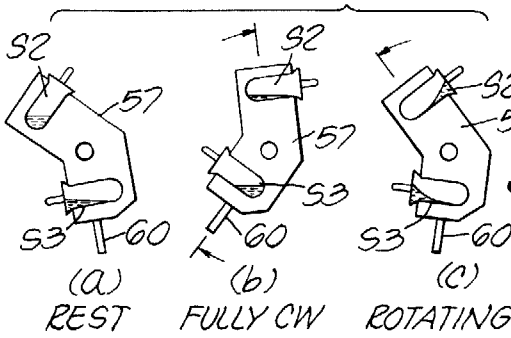
FIG. 9 is a diagrammatic view showing three different operating positions of the two switches controlled by the rear left hand sensor arm and corresponding to the positions of that arm designated (a), (b) and (c) in FIG. 8.
Figure 10:
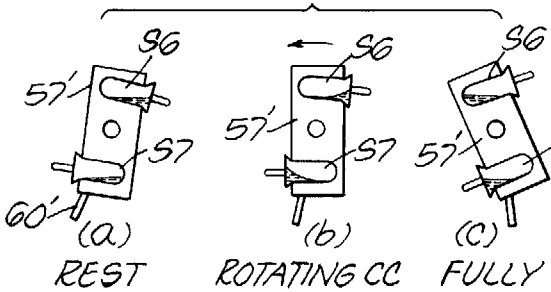
FIG. 10 is a diagrammatic view taken along line 10—10 on FIG. 8 showing three different operating positions of the two switches controlled by the forward right hand sensor arm and corresponding to the positions of that arm designated (a), (b) and (c) in FIG. 8.

Referring now to FIGS. 9 and 10, there are shown three different operating positions of carrier 57′ and the conditions of the mercury switches mounted thereon in these three positions. For example, in its normal rest position, sensor arm L1 is in the position (a) shown in dot and dash lines in FIG. 8, the corresponding position of switch carrier 57 being represented in position (*a*) in FIG. 9. Under these normally prevailing conditions, switch S2 is open and switch S3 is closed. Position (*b*) of arm L1 shows the sensor arm at the moment the front cart wheel passes out of contact with the outer end of the sensor arm. At this time, both of switches S2, S3 are open and the mercury is remote from the insulated contactor at the outer end of each switch. In this connection, it is pointed out that the bulbous housing of the mercury switches is conductive and secured to the metallic carrier member 57, the other contact of the switch being mounted in an insulative closure for the outer end of this housing and connected to the spring coil conductor 72 (FIGS. 5 and 6). Both of these conductive coil springs 72 as well as spring 68 are effective and cooperate in snapping the switch carrier 57 abruptly back toward its starting position (*a*). During the initial retrograde movement of the switch carrier by springs 68 and 72, the mercury in switches S2, S3 is thrown by centrifugal action, as represented by position (*c*) in FIG. 9, into the terminal end of each switch, thereby simultaneously closing switches S2, S3 momentarily. Springs 68 and 72 then hold carrier 57 in its starting position and the mercury gravitates to the inner closed end of switch S2. At the same time, spring 64 returns arm L1 to its normal outstretched position (*a*) (FIG. 8).

A similar but slightly different action occurs with respect to the switches operated by the two forward sensor arms L2, R2, in that the switches controlled by these arms close during forward movement of their respective control arms whereas switches R1, L1 close only after passage of the vehicle wheel thereby allowing these arms to snap back to their normal positions. In the normal rest position (*a*) it will be noted that S6 is closed and that S7 is open but in readiness to close upon slight forward movement of arm R2 as the right front cart wheel starts past this sensor arm. Switch S10, controlled by arm L2, is not normally a part of the electrical control circuit but its coil spring terminal 72′ cooperates with the similar spring terminal 72′ of switch S9 in returning these switches and their supporting arm 57′ to their normal inactive positions. Structurally, the two forward switch assemblies associated with arms R2 and L2 are similar and need not be described in greater detail at this point.

THE LOGIC ASSEMBLY

Figure 11:
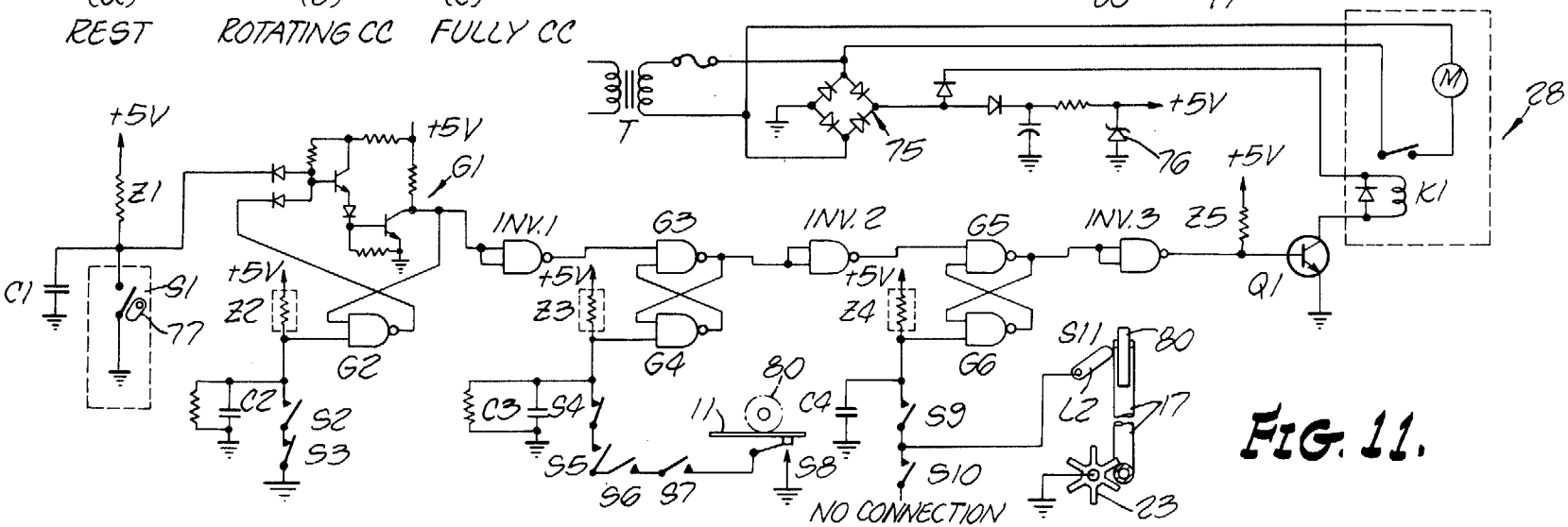
FIG. 11 is a schematic of the logic circuit controlling operation of the vehicle return acknowledgment and resettig mechanism.

The logic assembly components are illustrated schematically in FIG. 11. That circuitry is powered by transformer T connected to any suitable alternating power supply having its output side connected to a suitable rectifier 75 and to the motor M of the receipt or premium dispensing device 28. The rectifier output is employed to power the logic circuitry and relay K1 controlling the power supply to motor M. It will be noted that the negative side of the latter power circuit is grounded and that the positive side provides a constant five volt output under the control of a constant voltage Zener diode 76. This five volt power supply will be understood as connected to each portion of the circuit labeled +5v.

The logic circuit proper comprises three flip-flop circuits each including a pair of NAND gates G1, G2, gates G3,G4 and gates G5, G6. NAND gates are also used for each of the inverters INV 1, 2 and 3. The NAND gates are preferably of the well known type schematically illustrated for gat G1 in FIG. 11. Since the operation of this gate is well known to those skilled in the electronic art, the showing of the remaining ones of the gates is by symbol. Since the several flip-flops are connected in series, they must be activated in sequence to provide an output signal from the final flip-flop G5, G6. When this occurs, Q1 is activated to complete a power circuit through relay K1 thereby closing its contacts and completing a power circuit to the motor driving dispenser 28. As motor M approaches the end of its operating cycle, a cam mounted on the shaft of the premium dispenser closes switch S1 momentarily (left hand end of FIG. 11) and completes a discharge circuit for capacitor C1. Accordingly, the previous constant five volt power supply impressed on the upper input to GI goes low causing this gate to reverse itself and this reversal is repeated through each of the flip-flops and each of inverters 1, 2 and 3 with the result that transistor Q1 is turned off thereby deactivating relay K1 and stopping dispenser motor M precisely at the end of one dispensing cycle. At this time, cam 77 on the dispenser drum has rotated to a position opening switch S1 thereby restoring a positive input to GI via power supply from the five volt plus buss through Z1.

OPERATION

The operation of the above described check-in system will be readily apparent from the foregoing detailed description of the equipment, the components of the sensor device 26 and its logic circuitry controlling the operation of the dispenser of acknowledgement device 28 and the reconditioning of the logic circuitry.

Let it be assumed that a person who has completed use of the vehicle or cart 17 wishes to return it to the check-in station and to receive acknowledgment of its return. This is accomplished simply by passing the cart or vehicle through the check-in station passageway in the manner illustrated in FIG. 1. As the front wheels 80 enter the station, they are guided by the converging pairs of guide rails 24 to center the front end of the cart accurately in the center of the main frame 12, 13. Similarly, the rear wheels 81 are accurately and automatically positioned by the guide rollers 22 at the outer ends of plates 19 to enter the entrance passage way with the frame uprights closely beside the inner edges of plates 19 as is clearly indicated in FIGS. 2 and 4.

It will be understood that the castings 50 supporting the sensor arms L1, L2, R1, R2 can be adjusted and shifted lengthwise of device 26 by adjusting the assembly bolts 51, the adjustment being such that the front cart wheels 80 are positioned to contact sensor arms L2, R2 as sensor arms L1 and R1 are or about to be released from the trailing edge of cart wheels 80, 80. For example, in FIG. 8, left wheel 80, as shown in solid lines, has just passed out of contact with the end of arm L1 as its makes first contact with arm L2. However, the right hand front wheel at this instant is shown still in contact with arm R1, but barely so, and with its forward side in initial contact with arm R2. Variants of this adjustment of the front wheels relative to each related pair of sensor arms are of course within the scope of the invention principles, the particular adjustment shown and described merely being illustrative and by way of example. In this exemplary arrangement, the switches associated with arms L1, R1 are about to control their respective control circuits as the forward sensor arms start moving through their operating cycles. LI is released momentarily before lever R1 is released by the right hand front cart wheel. R1 is so positioned that it is not released to control its switches until arm R2 has begun to move through its cycle. At this point, it is to be noted that switches S4, S5 under the control of arm R1 are in series with switches S6, S7 controlled by arm R2. Furthermore and as herein shown, these four switches are in series with a pressure responsive switch S8 which comprises a microswitch or the like located beneath the base plate 11 of the check-in station and arranged to be closed by the weight of the front cart wheel 80 as the wheel passes in contact with arm R2. Accordingly, all five switches S4, S5, S6, S7, S8 must be closed simultaneously in order to ground the charge normally present on capacitor C3.

The manner in which the front wheels activate the several flip-flops in a particular sequence will now be described, it being pointed out in advance that L1 controls the first flip-flop, that R1, R2 and S8 cooperate to control the second flip-flop, and that L2 in circuit with the cart itself controls the third flip-flop.

Arm L1 is the first one contacted by the left hand front wheel 80. L1 then being in position (*a*). As is made clear by FIG. 9, S2 is then open and S3 is closed. When the left wheel 80 approaches the full line position shown in FIG. 8, both S2 and S3 are open for reasons made clear by FIG. 9. However, a moment later L1 is free to rotate counterclockwise under the control of springs 64, 68 (FIG. 6). Accordingly, support member 57 for the two switches is pivoted quickly and abruptly counterclockwise thereby causing the mercury in S2 and S3 to both close momentarily by centrifugal action. This closing grounds the charge on capacitor C2 causing the then 5v potential on G2 to go low thereby reversing flip-flop G1, G2, and putting a +5v potential on the input to G3 and conditioning this flip-flop for operation. In this connection, it is pointed out that each flip-flop must have a +5v input on the upper input of the flip-flop's upper gate to be in condition for operation by its control sensor arm or arms. Then the lower input to the lower gate of each flip-flop must be made low, as by grounding through the switches. Accordingly, at that time the output of each flip-flop is low. The low output now prevailing on the first flip-flop is inverted by inverter INV 1 thereby placing a +5v potential on G3 and thereby conditioning the second flip-flop G3, G4 for operation.

The activation of the second flip-flop G3, G4 is accomplished by the combined action of arms R1, R2 and of the weight sensing switch S8. As the right hand front wheel 80 passes arm R1, the wheel pivots R1 counterclockwise, then relases R1, closing switches S4, S5 momentarily be centrifugal action in precisely the same manner described above in connection with the operation of the similarly supported switches S2, S3. Concurrently with this operation, wheel 80 is contacting and pivoting R2 counterclockwise. The two mercury switches S6 and S7, mounted on member 57', are so arranged that both S6 and S7 are closed only after slight pivotal movement to position (*b*) (FIG. 10). Lever R2 is now in the dash line position (*b*) (FIG. 8). At this time the weight of one of the cart wheels, as the front right wheel 80, is holding the weight responsive microswitch closed. Hence, all five switches S4, S5, S6, S7, S8 are closed to complete a circuit to ground through capacitor C3. In consequence, the potential on both inputs to G4 are low thereby reversing the condition of the second of the second flip-flop G3, G4 and changing the output of the latter to low. This low potential is inverted by inverter 2 to place a +5v potential on the upper input to G5 thereby conditioning the third flip-flop for operation by arm L2.

The left hand front wheel 80 is now in readiness to activate the third flip-flop G5, G6. This is accomplished by the simultaneous closing of switches S9 and S11, as shown in FIG. 5. Switch S9 is closed after left wheel 80 has pushed L2 sufficiently to rotate member 57' clockwise and tilt S9 until the mercury contacts the terminal end. Switch S10 acts as a spring holder only and is not a part of the electrical circuit. Switch 11, however, differs from all other switches in that it is in circuit with metal components of the cart or vehicle itself as is diagrammatically illustrated in the lower right corner of FIG. 11. Thus it will be understood that S9 is connected in series with the conductive sensor arm L2. The outer free end of this arm passes in contact with the metal castor brackets supporting vehicle wheel 80. The castor is of course journalled on the main metal frame of the vehicle which main frame includes a metal tubing supporting the rear wheels 81. This metal tubing, being a part of the vehicle frame and in contact with guide plate 19 and/or the one-way star wheels 23, is grounded and completes a discharge circuit for capacitor C4 when switch S9 is also closed. This occurs when the metal castor of left front wheel 80 contacts L2 thereby closing S11, S9 then being held closed by arm L1. Flip-flop G5, G6 is reversed and its high output goes low. This low signal is inverted by inverter 3 causing the signal on the base of Q1 to go high thereby turning on the power circuit through relay K1 to dispenser motor M.

Motor M operates the dispensing drum of that device issuing a predetermined length 29 (FIG. 1) of a continuous strip of material stored in the dispenser thereby acknowledging the receipt and return of the cart through the check-in station. As soon as the dispensing cycle approaches its end, cam 77 driven by motor M closes switch S1 momentarily thereby grounding the charge on capacitor C1. This reverses each of the three flip-flops substantially instantaneously, turning off Q1 and de-energizing relay K1 and dispenser motor M. As the motor stops, switch S1 opens with the result that C1 recharges and the full +5v potential is restored to G1, conditioning flip-flop G1, G2 for operation.

The check-in station and sensor device 26 is now fully reset and in readiness for the next check-in operating cycle.

Referring to FIG. 2, it is also pointed out that the interval between the operation of the sensor arms L1, L2 can be adjusted very simply without need for making any adjustment on any mechanical component or in the setting of the switches or in the values of the timing capacitors, such as C4, merely by varying the height of a ramp along passageway 25. Such a ramp 90 is shown in FIG. 2 supported on base 11 and having a length corresponding generally to the length of sensor device 26. This ramp can have any of a range of heights and is effective to elevate the front left wheel 80. This effect is to vary the distance the front wheel travels between its point of last contact with arm L1 and its first contact with arm L2. It will be equally clear that a similar result is achieved by employing ramps of different heights between arms R1, R2. It will also be understood that ramp 90 can be used to detect vehicles of a competitor if those vehicles have wheels of a different size or spacing. For this purpose, ramp 90 can be so adjusted and positioned in one or both passageways 25 that a competitor's carts will or will not, pass over the ramp with the result that the non-authorized carts will be detected by the sensor and an acknowledgment will not be issued by device 28.

If the vehicle being checked in has a rigid front end, as do shopping carts, the presense of ramp 90 in either passageway modifies the operation of the sensor switches in respects readily apparent from the foregoing detailed description with the result that the sensor device 26 does not provide an output signal to device 28. Other modes of adjusting the timing characteristics of the logic circuitry are to vary the size of capacitors C1, 2, 3 and 4.

Star wheels 23 (FIG. 2) are positioned as required by the vehicle size to prevent any backward motion of the vehicle after the wheel has reached a position activating dispenser 28.

While the particular apparatus for receiving and acknowledging the return of a vehicle at a check-in station herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other that as defined in the appended claims.

I claim:

1. Apparatus for receiving and acknowledging the return of a wheel-supported vehicle at a check-in station, said apparatus having passageway means for accommodating a returning vehicle, a plurality of sensors adjacent said passageway means operable in preselected sequence in response to the movement of a returning vehicle therethrough in a predetermined direction, means responsive to the proper sequential operation of said sensors to acknowledge the return of a vehicle through said passageway means, and said sensors including means effective to thwart efforts of unauthorized persons to operate said sensors in the proper sequence to simulate the return of a vehicle and obtain a false acknowledgment thereof.

2. Apparatus as defined in claim 1 characterized in that said means for acknowledging the return of a vehicle includes means for dispensing an item to the person returning a vehicle as an incident of the sensor operating cycle.

3. Apparatus as defined in claim 1 characterized in the provision of means effective to prevent retrograde movement of a vehicle after the vehicle has reached a predetermined position of advance along said passageway means thereby safeguarding against the passage of a given vehicle past said sensors more than once by the same vehicle operator.

4. Apparatus as defined in claim 1 characterized in that said sensors include a multiplicity of switches operable in closely spaced timed sequence and including means providing a desired acknowledgment result only if said switches are operated in a preselected sequence.

5. Apparatus as defined in claim 4 characterized in that some of said switches are normally open and others are normally closed.

6. Apparatus as defined in claim 4 characterized in that some of said switches are responsive to impact to move momentarily to an alternate operating position.

7. Apparatus as defined in claim 1 characterized in that said sensors include more than two movably supported arms in the path of a vehicle moving therepast and each operatively associated with independently operable switch means and including means providing an output result only when said switches are operated to an alternate position thereof in a predetermined sequence.

8. Apparatus as defined in claim 7 characterized in that said arms are arranged along the path of travel of a vehicle moving along said passageway means and engageable with said vehicle while moving along said passageway means.

9. Apparatus as defined in claim 7 characterized in that said arms are arranged in the path of travel of means mounted on and forming a part of a vehicle moving along said passageway means, and said arms so positioned that certain thereof are released from a deflected position as other of said arms begin to move away from a normal position of rest.

10. Apparatus as defined in claim 9 characterized in that certain of said arms include a plurality of related switches all of which are in a closed position momentarily only when said certain arms have been released from contact with a returning vehicle.

11. Apparatus as defined in claim 10 characterized in that other of said arms include a plurality of related switches all of which are actuated to closed position momentarily in time delayed sequence relative to the closing of said certain switches.

12. Sensor apparatus for sensing the passage of a wheeled vehicle through a vehicle check-in station and to provide an electrical output signal to acknowledge the return of a vehicle to the check-in station, comprising: main frame means movably supporting a multiplicity of sensor arms positioned to be engaged by one or more wheels of a vehicle moving forwardly therepast and including means normally biasing said arms to a neutral position in readiness to be engaged by the vehicle wheels, a plurality of switches operatively associated with said arms respective ones of which are momentarily effective to activate a control circuit in a prearranged pattern to provide an output signal only if said switches have been closed in said prearranged pattern thereby to confirm the return of the vehicle through said check-in station.

13. Sensor apparatus as defined in claim 12 characterized in that some of said sensor arms are positioned for engagement by one vehicle wheel and others are positioned for engagement by a different vehicle wheel as the vehicle passes through said check-in station.

14. Sensor apparatus as defined in claim 12 characterized in that at least one pair of said sensor arms is so positioned that the foremost one thereof is about to be actuated by a forwardly moving vehicle wheel as the rearmost one thereof is being released from a deflected position thereof by the passage of the same vehicle wheel therepast.

15. Sensor apparatus as defined in claim 12 characterized in that said sensor arms are pivotable through limited arcs forwardly and rearwardly of a normal neutral position with the outer free ends thereof in the path of a forwardly moving vehicle wheel passing through said check-in station.

16. Sensor apparatus as defined in claim 15 characterized in that said means biasing said sensor arms in neutral position comprises spring means for returning the arm to neutral position abruptly after being released from a deflected position.

17. Sensor means as defined in claim 15 characterized in that said switch means comprises mercury switches at least one of which closes momentarily by inertia action resulting from a sudden change in the movement of said one switch.

18. Sensor means as defined in claim 15 characterized in that one of said switches is inertia responsive to change from one to another operating condition thereof in response to a sudden change in the movement of the switch.

19. Sensor apparatus as defined in claim 12 characterized in the provision of a plurality of said sensor arms positioned to be engaged by at least one wheel on the opposite sides of the vehicle and each arranged to activate an associated control circuit momentarily and at least some of which control circuits include a plurality of switches at least one of which is normally open.

20. Sensor apparatus as defined in claim 19 characterized in the provision of adjustable means for varying the time interval between the activation of said control circuits.

21. Sensor apparatus as defined in claim 19 characterized in the provision of means for varying the vertical spacing between the surface over which the vehicle wheels pass and the point of contact of the vehicle wheel with said sensor arms thereby to vary the time interval between the sequential activation of the electrical circuit controlled by two associated ones of said sensor arms.

22. Sensor apparatus as defined in claim 12 characterized in the provision of removable access cover means for said sensor apparatus except for the outer ends of said sensor arms which outer ends protrude therebeyond, said cover and said main frame including interlocking parts concealed by said cover when in place which inter-engage as said cover is moved a limited distance in only a single direction when assembled over said main frame, and key operated means movable between locked and unlocked positions and, when locked, cooperating with means concealed by said cover to prevent disengagement of said interlocking parts.

23. Sensor apparatus as defined in claim 12 characterized in the provision of detachable cover means or said main frame and including a key operated lock normally holding the cover locked to said main frame and including means thwarting replacing said cover means by unauthorized persons, said last mentioned means including interfitting detents on said cover means and said main frame arranged for assembly only when manuevering said cover through a specific predetermined path difficult to discover.

24. Sensor apparatus as defined in claim 12 characterized in the provision of means operable by said output signal to issue token means evidencing return of a vehicle past said sensor means.

25. Sensor apparatus as defined in claim 12 characterized in the provision of means for restoring the components to their respective initial starting condition and in readiness to sense the return of another vehicle through said check-in station.

26. Sensor apparatus as defined in claim 12 characterized in the provision of means for issuing a predetermined number of segments from a continuous strip of flexible material following the movement of each vehicle through said check-in station.

27. Sensor apparatus as defined in claim 26 characterized in the provision of means interconnecting said last named means and said sensor means for restoring said sensor means to the initial starting condition thereof as an incident to the issuance of said segments and the passage of a vehicle through said check-in station.

28. Cart check-in apparatus comprising means providing a passageway for wheel-supported carts while being rolled from one area to another on the wheels thereof, means including sensor means located adjacent said passageway actuable in response to movement of a cart therealong in a predetermined direction to indicate the passage of the cart and including a multiplicity of mutually cooperating means effective to acknowledge the passage of a cart along said passageway only if said mutually cooperating means are actuated in a predetermined sequence, and sensor means being mounted in a protective enclosure supported intermediate the opposite ends of said passageway, said sensor means including a plurality of movable arms extending from said protective enclosure each engageable by a cart as an incident to the movement of a cart along said passageway, and means for restoring each of said arms to a selected normal position thereof after the same has been deflected by the passage of a cart along said passageway, said sensor arms being mounted for engagement and deflection by at least one of the cart wheels, one of said sensor arms being arranged to be released from a deflected position as another of said sensor arms starts to move away from its normal position of rest.

29. Cart check-in apparatus comprising means providing a passageway for wheel-supported carts while being rolled from one area to another on the wheels thereof, means including sensor means located adjacent said passageway actuable in response to movement of a cart therealong in a predetermined direction to indicate the passage of the cart and including a multiplicity of mutually cooperating means effective to acknowledge the passage of a cart along said passageway only if said mutually cooperating means are actuated in a predetermined sequence, said sensor means being mounted in a protective enclosure, said sensor means including a plurality of movable arms extending from said protective enclosure each engageable by a cart as an incident to the movement of a cart along said passageway, and means for restoring each of said arms to a selected normal position thereof after the same has been deflected by the passage of a cart along said passageway, a portion of a cart being positioned to engage respective ones of said sensor arms in sequence as the cart moves along said passageway, and said arms being so positioned relative to said cart that one of said arms is being released from a deflected position thereof substantially at the same time another of said arms is beginning its deflection movement.

30. Apparatus as defined in claim 29 characterized in that the switches actuable by said arms are arranged to close in closely spaced time delayed sequence of a predetermined order thwarting detection by unauthorized persons lacking knowledge of the operating sequence.

31. Cart check-in apparatus comprising means providing a passageway for wheel-supported carts while being rolled from one area to another on the wheels thereof, means including sensor means located adjacent said passageway actuable in response to movement of a cart therealong in a predetermined direction to indicate the passage of the cart and including a multiplicity of mutually cooperating means effective to acknowledge the passage of a cart along said passageway only if said mutually cooperating means are actuated in a predetermined sequence, said means actuable to indicate the passage of a cart along said passageway including electrical circuit means formed in part by conductive portions of the cart itself.

32. Apparatus as defined in claim 31 characterized in that at least one of said sensor arms includes conductive means located in and serving as part of said electrical circuit with said cart while the latter is engaging at least said one sensor arm.

33. Cart check-in apparatus comprising means providing a passageway for wheel-supported carts while being rolled from one area to another on the wheels thereof, means including sensor means located adjacent said passageway actuable in response to movement of a cart therealong in a predetermined direction to indicate the passage of the cart and including a multiplicity of mutually cooperating means effective to acknowledge the passage of a cart along said passageway only if said mutually cooperating means are actuated in a predetermined sequence, one-way clutch means including a generally horizontally disposed star wheel rotatable in only one direction and including spoke-like arms engageable by an upright portion of one side of a cart as it moves forwardly along said passageway toward said sensor means, and means for supporting said one-way clutch means selectively in different positions to accommodate said check-in apparatus for use with carts of different sizes and designs.

34. Cart check-in apparatus comprising means providing a passageway for wheel-supported carts while being rolled from one area to another on the wheels thereof, means including sensor means located adjacent said passageway actuable in response to movement of a cart therealong in a predetermined direction to indicate the passage of the cart and including a multiplicity of mutually cooperating means effective to acknowledge the passage of a cart along said passageway only if said mutually cooperating means are actuated in a predetermined sequence, a base plate adapted to rest flush against the floor, and rigid frame means on said base plate forming an elongated open-ended passageway for carts, said sensor means being mounted on said base plate intermediate the ends of said passageway.

35. Apparatus as defined in claim 34 characterized in the provision of means for adjusting the width and height of said rigid frame means to accommodate carts of different size.

36. Cart check-in apparatus comprising means providing a passageway for wheel-supported carts while being rolled from one area to another on the wheels thereof, means including sensor means located adjacent said passageway actuable in response to movement of a cart therealong in a predetermined direction to indicate the passage of the cart and including a multiplicity of mutually cooperating means effective to acknowledge the passage of a cart along said passageway only if said mutually cooperating means are actuated in a predetermined sequence, a base plate underlying and supporting said passageway for a cart, guide channel means extending lengthwise of said base plate and cooperating to provide parallel channels along which the front wheels of a cart must pass when passing through said passageway, said sensor means including means engageable with a part of a cart as the front wheels thereof are passing along said guide channel means, said sensor means including a plurality of independently pivotable arms positioned to be engaged by more than one wheel of said cart and to be pivoted thereby in out-of-phase sequence as a cart passes forwardly along said passageway from the entrance end thereof.

37. Apparatus as defined in claim 36 characterized in that said pivotable arms are positioned to be engaged by one or the other of a pair of front wheels of a cart as the same passes along said passageway.

38. Apparatus as defined in claim 36 characterized in that said arms, said front wheels and said base plate are temporarily connected in circuit with and form a part of said means for acknowledging the passage of a cart along said passageway only if said mutually cooperating means are actuated in a predetermined pattern.

39. Sensor apparatus for sensing the passage of an object therepast and operable to provide an output signal to indicate the passage of the object therepast in a particular direction comprising: main frame means movably supporting a plurality of sensors normally biased to a neutral position in the path of the object to be sensed as it passes said sensor apparatus, a set of control devides operatively associated with a respective one of said sensors and with one another and cooperating to provide an output signal only if each set of said control devices is activated in a particular manner and sequence by the passage of an object in contact with said sensors, indicator means operatively connected for activation by said output signal thereby to provide a positive acknowledgment that an object has passed said sensors, said sensors each including an independently movable arm having one end thereof normally in a neutral position in readiness to sense the approach of an object from a particular direction and including means for restoring said arm to said neutral position after passage of the object, said object being wheel supported, a pair of said sensor arms being so positioned with respect to one of said wheels that the trailing edge of the wheel disengages the first contacted one of said arms substantially as the advance edge of that wheel approaches and starts to deflect the next one of said arms forwardly away from its normal neutral position whereby to activate the control devices associated with said arms in predetermined closely spaced sequence.

40. Sensor apparatus as defined in claim 39 characterized in that the control devices associated with said first arm are activated upon release of said first arm by the rear edge of said one wheel and the control devices associated with said second arm are activated as said second arm starts to be moved away from the neutral position thereof, and said control devices being constructed and arranged to remain in activated condition but momentarily.

* * * * *

UNITED STATES PATENT OFFICE
CERTIFICATE OF CORRECTION

Patent No. 3,938,638 Dated February 17, 1976

Inventor(s) Richard D. Moule

It is certified that error appears in the above-identified patent and that said Letters Patent are hereby corrected as shown below:

Column 2, line 14 delete "IF" and add --utilized"

Column 4, line 46 "includig" should be --including--

Column 10, line 15 "L1" should be --L2--

Column 10, line 62 "presense" should be --presence--

Signed and Sealed this

Fourth Day of January 1977

[SEAL]

*Attest:*

RUTH C. MASON
*Attesting Officer*

C. MARSHALL DANN
*Commissioner of Patents and Trademarks*